United States Patent [19]

Yakuboff

[11] 4,046,103

[45] Sept. 6, 1977

[54] IMPREGNATING DIE

[75] Inventor: Paul D. Yakuboff, Newark, Ohio

[73] Assignee: Owens-Corning Fiberglas Corporation, Toledo, Ohio

[21] Appl. No.: 671,654

[22] Filed: Mar. 29, 1976

[51] Int. Cl.[2] ..... B05C 11/02; B05C 11/10

[52] U.S. Cl. ..... 118/125; 118/405; 118/DIG. 18; 425/113

[58] Field of Search ..... 118/125, 404, 405, DIG. 18; 277/110, 115; 425/113

[56] References Cited

U.S. PATENT DOCUMENTS

| | | | |
|---|---|---|---|
| 1,131,623 | 3/1915 | Burton | 118/125 X |
| 2,787,980 | 4/1957 | McDermott | 118/405 |
| 2,960,063 | 11/1960 | Martuch | 118/125 X |
| 3,090,352 | 5/1963 | Knapp | 118/405 |
| 3,308,787 | 3/1967 | McDermott | 118/125 |
| 3,898,113 | 8/1975 | Meyer et al. | 118/125 X |

FOREIGN PATENT DOCUMENTS

| | | | |
|---|---|---|---|
| 943,151 | 11/1963 | United Kingdom | 118/125 |
| 724,952 | 2/1955 | United Kingdom | 118/405 |

*Primary Examiner*—James Kee Chi

*Attorney, Agent, or Firm*—John W. Overman; Ronald C. Hudgens; Ted C. Gillespie

[57] ABSTRACT

A die for impregnating yarn is provided with a die insert having a minimum inside diameter. An inlet duct opening into the die has walls with length L, the walls sloping at an angle within the range of from about 5 degrees to about 25 degrees. The length of the inlet duct is within the range of from about 10 to about 25 times the minimum inside diameter of the die insert. The maximum diameter of the inlet duct is within the range of from about 15 to about 35 times the minimum inside diameter of the die insert.

5 Claims, 4 Drawing Figures

IMPREGNATING DIE

This invention relates to a die which can be used for coating or impregnating a traveling yarn with a fluid.

In the production of impregnated yarn, e.g. tire cord, a traveling yarn is passed through a dip tank containing a desired impregnant. The impregnant can be an aqueous latex solution, and can vary in viscosity from about 25 centipoises up to about 2500 centipoises. The yarn, after impregnation, travels out of the tank and through a die. The die serves to wipe excess impregnant from the yarn and to create an impregnated yarn of uniform diameter. The die also serves to force the impregnant into the inner regions of the yarn for a complete impregnation.

A die insert, generally made of tungsten or some other very hard material, provides a bore with a minimum inside diameter for desirable impregnating and sizing of the yarn. Advances in the impregnating die art have led to the use of a diamond material for a portion of the die insert. The diamond, having a higher resistance to wear by abrasion, outlasts the tungsten portion of the die insert, and thus is able to maintain the desired minimum bore diameter for a longer period of time.

An inlet duct at the entrance to the die insert bore serves to flood the inlet side of the die with the impregnant. The flow of the impregnant in the inlet duct also serves to flush stray fibers and impurities away from the entrance of the die insert bore.

Ideally, the build-up of impregnant within the inlet duct is relieved by a steady dripping or stream of excess impregnant from the inlet duct into an appropriate receptacle, or perhaps the dip tank itself. Standard dies in use today are defective, however, in that the excess impregnant gathered in the inlet duct tends to splash out violently, coating the surrounding environment with the sticky impregnant. An additional problem with the standard dies of the prior art is that they are prone to flooding. Excess impregnant in the inlet duct travels around to the exit end of the die, thereby interfering with the smoothness and desired diameter of the exiting impregnated yarn. A flooded die requires a cessation of the impregnating operation for cleaning, and production is lost. Flooding and splashing problems are further intensified by efforts to increase production through increased yarn speeds.

It has been found that, for a given minimum inside diameter of a die insert bore, the length of the inlet duct, the diameter of the inlet duct and the angle of slope of the inlet duct are all critical in preventing flooding of the die and splashing of the impregnant.

According to this invention there is provided a die for impregnating a traveling yarn.

Also, according to this invention there is provided a die which has a die insert with a minimum inside diameter *d*. An inlet duct with a length L has a frustro-conical inner surface sloping inwardly toward the die insert. The slope of the inner surface is within the range of from about 5° to about 25°. The length L of the inlet duct is within the range of from about 10 to about 25 times the minimum diameter *d*. The largest inside diameter D of the inlet duct is within the range of from about 15 to about 35 times the minimum inside diameter *d*. A portion of the die insert can be comprised of a diamond material.

This invention will be more fully understood by reference to the following drawings.

The following description of a preferred embodiment is offered for purposes of illustration of the principles of this invention, and it is not intended to be limiting.

Figure 1:
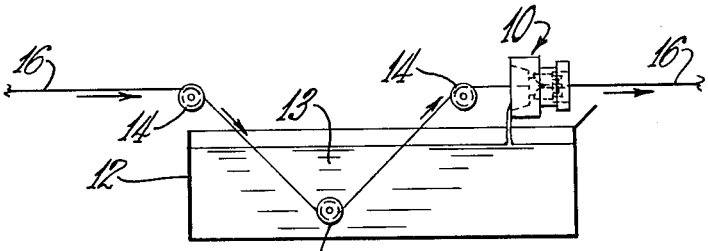
FIG. 1 is a schematic view of a yarn-impregnating operation.

A yarn impregnating operation, as shown in FIG. 1, includes die 10, dip tank 12 containing the impregnant 13 and yarn guiding apparatus 14. The yarn 16 is propelled by conventional means which is not shown. As the yarn leaves the tank it is covered with the impregnant. The die forces a complete impregnation of the yarn, causing excess impregnant to drip back into tank 12.

Figure 2:
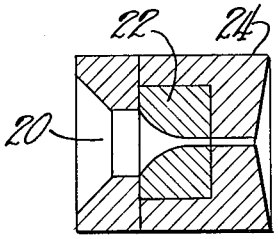
FIG. 2 (PRIOR ART)
FIG. 2 is a cross-sectional view of a standard die of the prior art.

The standard die of the prior art as shown in FIG. 2 includes an inlet duct 20, a die insert 22 and a backing means 24 for holding die insert 22 in place. The standard die of FIG. 2 has operational problems in that the impregnant is prone to flooding around to the exit end of the die. Additionally, the excess impregnant in inlet duct 20 has a tendency to splash onto the surrounding surfaces, rather than steadily dripping or streaming into an appropriate receptacle.

Figure 3:
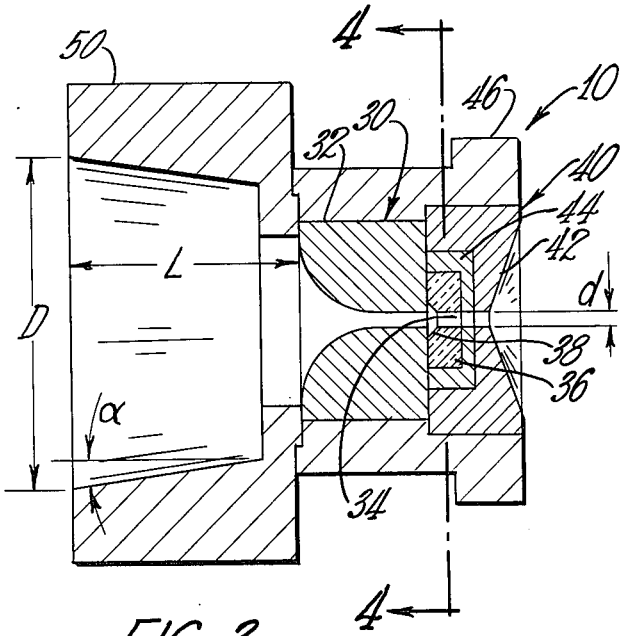
FIG. 3 is a cross-sectional view of a die according to the principles of this invention.

A preferred embodiment of the die of this invention, as shown in FIG. 3, includes die insert 30, retaining assembly 40 and inlet duct 50. The die insert is comprised of an insert member 32 having a tapered center bore 34. The bore tapers to a minimum inside diameter *d* as shown. Insert member 32 is preferably made of tungsten or some other very hard material. Die insert 30 can alsc contain a supplementary insert 36, preferably comprised of still harder material such as a diamond material. The supplementary insert can be beveled as shown, defining an annular recess 38 in bore 34 which permits compensation for any slight misalignment in bore 34.

Retaining assembly 40 is comprised of a die insert retaining member 42, a supplementary die insert retaining member 44 and an outer casing 46. Die insert retaining member 42 can be made of stainless steel. Supplementary die insert retaining member 44 can be made of an appropriate potting material. Supplementary die insert retaining member 44 holds supplemental insert 36 in place. Die insert retaining member 42 holds die insert 32 in place. Outer casing 46 provides a support framework for the entire retaining assembly 40. The rear portion of die inert retaining member 42 is beveled to facilitate a clean exit of the yarn from the die.

Figure 4:
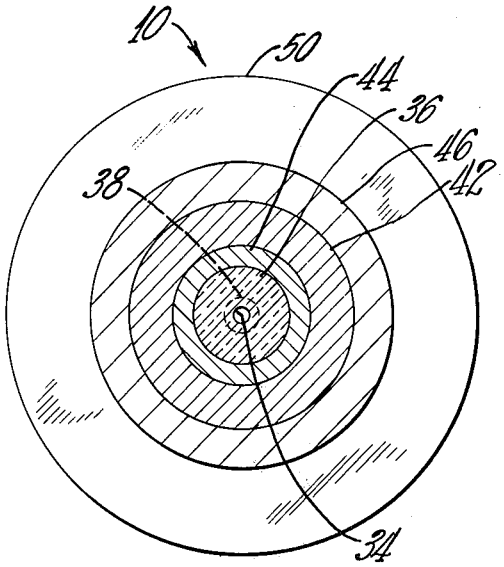
FIG. 4 is a cross-sectional view of the die as seen along section line 4—4 of FIG. 3.

The cross-sectional view of the die as shown in FIG. 4 includes bore 34, supplementary die insert 36, supplementary die insert retaining member 44, die insert retaining member 42, outer casing 46 and inlet duct 50.

Inlet duct 50, as shown in FIG. 3, has a frustro-conical inner surface which slopes at an angle alpha. The angle alpha lies within the range of from about 5° to about 25°. Inlet ducts having sides sloping at angles outside this range are more prone to the problems of splashing and flooding.

The length of inlet duct 50 is designated by the letter L in FIG. 3. The length L can be defined by the relation $$L = rd$$

where $r$ has a value within the range of from about 10 to about 25, and $d$ is the minimum inside diameter of bore 34. The length L is limited at its upper end because of problems related to threading the die with the yarn at start-up. An inlet duct with a length L which is too short (i.e. where $r$ is below the above-defined range) will permit undesirable flooding and splashing problems. It is to be understood that both L and $d$ are measured in the same units of measurement.

The maximum diameter of the inner surface of inlet duct 50 is designated by the letter D in FIG. 3. Diameter D can be defined by the relation $$D = sd$$

where $s$ has a value within the range of from about 15 to about 35, and $d$ is the minimum inside diameter of bore 34. Inlet ducts having a diameter not defined by the above relation will have undesirable flow patterns of the impregnant and cause splashing and flooding. It is to be understood that both D and $d$ are measured in the same units of measurement.

In a preferred embodiment the angle alpha of the slope of inlet duct 50 is about 8°. The parameter $r$ has a value of about 16, and the parameter $s$ has a value of about 24.

It will be evident from the foregoing that various modifications can be made to this invention. Such, however, are believed to be within the scope of the invention.

I claim:

1. A die comprising:

a. a die insert having a bore with a tapered entrance, said bore tapering to a minimum inside diameter $d$; and, b. an inlet duct having a frustro-conical inner surface, said inlet duct opening into said bore, said surface sloping inwardly at an angle about 8°, said inlet duct having a length L, said length L being defined by the relation $$L = rd$$

wherein $r$ is a parameter having a value within the range of from about 10 to about 25, and said inlet having a maximum inside diameter D, said diameter D being defined by the relation $$D = sd$$

wherein $s$ is a parameter having a value within the range of from about 15 to about 35.

2. The die of claim 1 wherein the value of $r$ is about 16.

3. The die of claim 1 wherein the value of $s$ is about 24.

4. The die of claim 1 wherein said die insert comprises a diamond insert.

5. The die of claim 4 wherein said diamond insert is beveled.

* * * * *